United States Patent [19]

Kammerer

[11] Patent Number: 4,667,772

[45] Date of Patent: May 26, 1987

[54] ASCENDER FOR ROPE CLIMBING, ADAPTED FOR USE WITH A CARABINER

[76] Inventor: Kent R. Kammerer, 731 N. 87th St., Kent, Wash. 98103

[21] Appl. No.: 758,690

[22] Filed: Jul. 25, 1985

[51] Int. Cl.[4] ..... A62B 35/00; A62B 1/20; A63B 29/02

[52] U.S. Cl. ..... 182/6; 24/115 M; 24/136 L; 188/65.2

[58] Field of Search ..... 182/5–8, 182/3, 133–136; 24/115 M, 136 R, 136 L; 188/65.1, 65.2

[56] References Cited

U.S. PATENT DOCUMENTS

| | | | |
|---|---|---|---|
| 428,812 | 5/1890 | Johanson | 182/135 |
| 462,081 | 10/1891 | Henning | 182/135 |
| 1,021,986 | 4/1912 | Johnson | 24/136 R |
| 1,114,235 | 10/1914 | Carteret | 24/136 R |
| 1,653,840 | 7/1926 | Byl | 24/115 M |
| 1,759,591 | 5/1930 | Pleister | 24/115 M |
| 2,781,212 | 2/1957 | Jugle | 24/115 M |
| 2,902,736 | 9/1959 | Hampe | 24/115 M |
| 3,492,702 | 2/1970 | Stafford | 182/5 |
| 3,814,210 | 6/1974 | Hoffman | 182/6 |
| 3,869,021 | 3/1975 | Sutherland | 182/3 |
| 4,019,609 | 4/1977 | Wagner | 188/65.4 |
| 4,040,754 | 8/1977 | Burroughs | 24/136 R |
| 4,253,218 | 3/1981 | Gibbs | 182/5 |
| 4,311,218 | 1/1982 | Steffen | 182/5 |

*Primary Examiner*—Reinaldo P. Machado
*Attorney, Agent, or Firm*—Roy E. Mattern, Jr.

[57] ABSTRACT

A mountaineering self rescue, no moving part, ascender is used in pairs in conjunction with standard mountaineering equipment, to allow a climber to ascend a safety rope without aid, beyond the belaying of the safety rope. This no moving part ascender is simple, light weight, unaffected by ice, and placed in position with one hand. The first embodiment consists of a U shaped housing, whose vertical sides extend horizontally from a vertical curved back. The interior of the curved back is serrated to increase friction and is placed to partially surround a belayed climbing or safety rope, defining a travel path for this rope. The oppositely spaced apart vertical sides, each have a mirror image longitudinal bias slot. Carabiners, with attached sling ropes, already carried by mountaineers, are snapped into the bias slots of the ascender. Then as the climber's weight is transferred from a sling rope to a carabiner, its downward travel in the bias slots of the ascender, place the carabiner into locking frictional contact with the safety rope. The second duplicate ascender of the pair is placed above, and is then moved upwardly on the safety rope by the climber. Thereafter, when the climber's weight is transferred alternately between the two ascender assemblies, the climber moves himself or herself upwardly. A second embodiment also uses carabiners and accommodates two side by side safety ropes.

2 Claims, 7 Drawing Figures

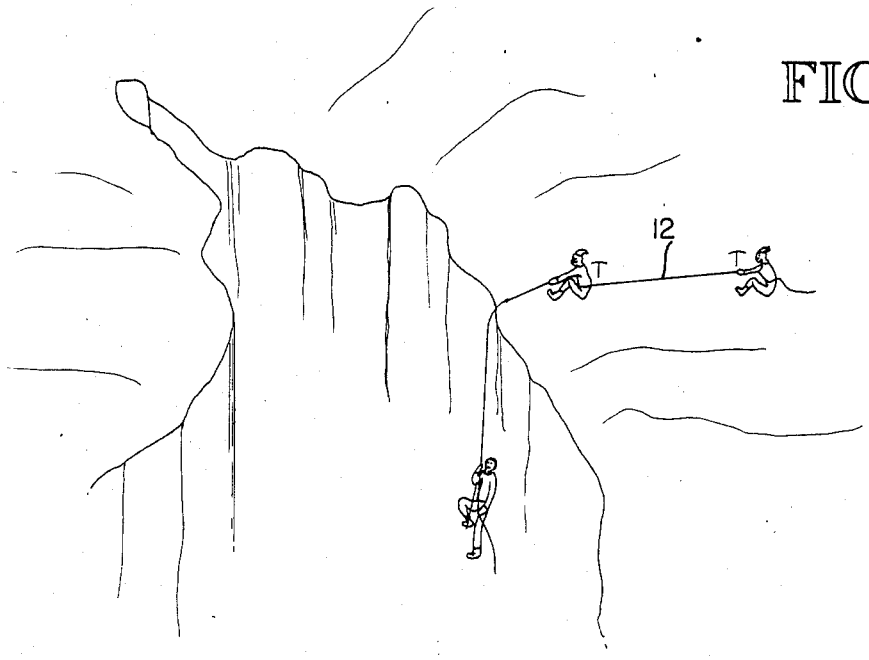
FIG. 1
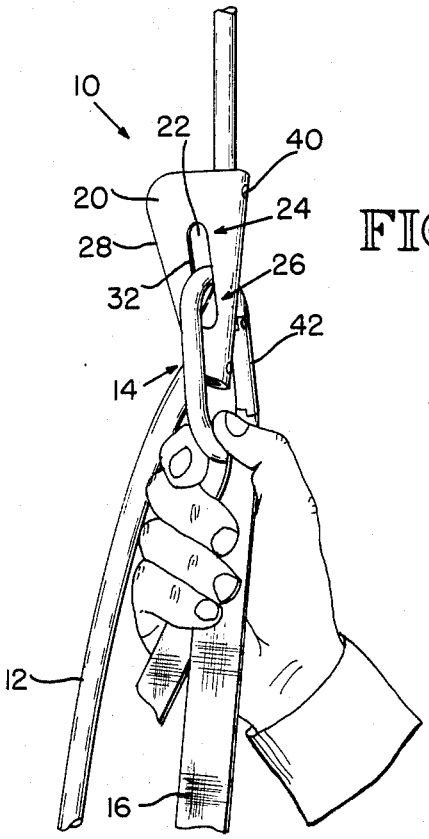
FIG. 3
FIG. 2
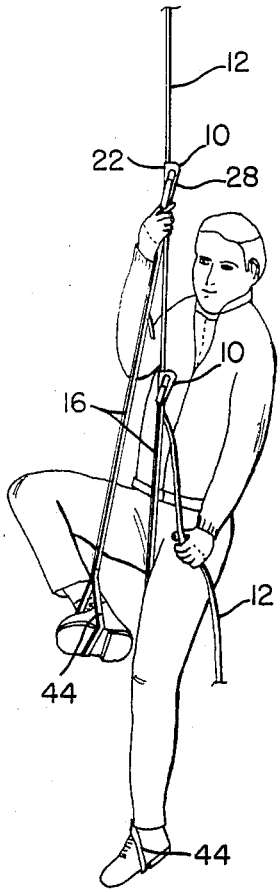

ASCENDER FOR ROPE CLIMBING, ADAPTED FOR USE WITH A CARABINER

BACKGROUND

The sport of mountain climbing frequently requires the climber to ascend fixed lines or safety ropes in a variety of situations. These situations particularly include crevasse rescue during a glacier climb where the climber falls into a crevasse and is supported by his or her safety rope. The safety rope is attached to each climber and in turn secures the climbers together at spaced intervals along its length. The climber must then use a prusiking technique to ascend the rope to safety. In addition, the need to ascend a suspended rope is often encountered by construction workers, sailors, window washers and the like.

Many apparatuses have been developed for allowing the alpinist to ascend a suspended rope wherein the apparatus is permitted free relative upward sliding travel along the rope a but that sliding movement of the apparatus in the opposite or downward direction on the rope is prevented and the weight of the alpinist is supported at the present position when a downward load is applied to the apparatus.

Particularly in glacier travel as briefly discussed above, one or more members of a climbing team roped together by the safety rope will sometimes slip and fall into a crevasse, requiring the assistance of his fellow climbers to perform an ice axe arrest to stop the climber's fall. In ascending from the crevasse, the fallen climber has typically relied on the use of what is known as a prusik line. The prusik line is secured at one end to the safety rope with a prusik knot while the other end forms a loop within which the climber may insert his foot. A pair of prusik lines are used wherin each prusik line may then be alternately slid upwardly along the rope allowing the climber to gain elevation whereby the knot adaptably resists downward sliding movement when a load of the weight of the climber is applied to the loop. There are many disadvantages with the prusik, particularly the inefficiency of this system when the safety rope and prusik line become frozen and covered with ice. A need remained for a device to serve as an improved substitute for the prusik which the climber could easily attach to the safety rope in crevasse rescue situations.

The device which has become well known in the sport is the spring loaded ascender of Gibbs, U.S. Pat. No. 4,235,3218, 1981. Gibbs' ascender comprises a spring loaded brake lever which is pivotally mounted at one end to a housing, through which a rope is inserted. The brake lever is adapted to function as a camming device, applying frictional forces against the rope when a downward load is applied to the brake lever. The ascender may be slidingly moved upward along the rope with the actuating spring maintaining constant pressure of the brake against the rope. Downward movement of the ascender along the rope is prevented when the downward load created by a climber's weight is applied to the brake lever.

The Gibbs invention and others, such as that of Hoffman, U.S. Pat. No. 3,814,210, 1975, have been developed primarily to allow the climber ascend a fixed rope which is suspended from a higher elevation. The climber may actually use these ascending devices to pull his or her own weight up the rope or may simply use the device, typically called an ascender, as a safety clamp to support this weight and maintain present position on the rope in case of a fall.

Similar equipment has been developed primarily for use as a braking apparatus, such as would be used in rappelling on a fixed or suspended rope or other activity when a person desires to control and reduce the speed of descending a rope using an aid. Wagner, U.S. Pat. No. 4,019,609, has developed a brake apparatus for use in rappelling wherein a brake bar is utilized in connection with two or more carabiners. A length of webbing is secured to the climber at one end and to the carabiners at the other. The rope used in the descent is then adaptably threaded through the carabiners and around the brake bar in such a fashion that the apparatus applies frictional forces to the rope as he climber begins the descent. Frictional forces allow the brake apparatus to travel down along the rope yet at reduced speed.

Despite the development of various braking and ascending equipment, there remains a need for climbers to have a simple and dependable apparatus which will allow safe ascent of a safety rope in a rescue situation or permit the climber to be able to ascend a fixed rope while climbing an ice wall or rock pitch, for example. In contrast to the inventions of Gibbs and others, an additional requirement was to provide an ascending apparatus that was not comprised of mechanical moving parts such as springs or cams which would require maintenance or could freeze or ice up or fail during use. A very light, single handed, manually operable apparatus was needed which would allow upward travel along the rope and prevent any downward movement once a load was applied.

Rappelling equipment, such as the inventions of Wagner and Stephen, have included standard carabiners in combination with a braking means. There remained a need, however, for an ascender which would utilize existing directly bear against a climbing rope to hold a climber at his or her selected elevation along the rope, rather than simply control the speed of movement along the rope and merely slow descent on the rope as Wagner and Stephens' inventions were designed to do.

SUMMARY

An ascender for climbing rope is adapted for use with one or more carabiners to ascend fixed ropes as well as to serve as an aid to climb a safety rope in crevasse rescue situations during glacier travel. The ascender substantially comprises an integral one piece structure, in a U-shaped configuration. Oppositely spaced apart sides extend from a back and each side has an elongated slot located therethrough. These slots are a mirror image of one another and are adapted to receive a carabiner used by mountaineers and further define a path of travel for the carabiner. The running surface defined by the interior of the U-shaped structure is adapted for the sliding travel of the rope during use of the ascender. The slots of the ascender are positioned relative to the back whereby their longitudinal axes extend to intersect the longitudinal axis of the running surface at an acute angle. The attached carabiner is thereby adapted for sliding travel within the slots to apply wedging forces and jam the rope against the running surface when a downward load created by the climber's weight is applied to the carabiner via an interconnected sling. Used in combination with standard climbing equipment, such as the carabiner, the ascender incorporates no cams, springs or other inherent mechanical or moving parts.

Each carabiner is generally equipped with a sling attached at one end and having a loop at the other end to receive the climber's foot. In most climbing situations, two ascenders are used, being easily insertably positioned around the suspended rope with a carabiner clipped through the slots of each ascender. Attachment of the carabiner provides a means of enclosures to keep the ascender loosely attached to the suspended rope. When no downward load is applied to the carabiner, its respective ascender may slidably travel with free action in either direction along the rope. When a downward load on the sling and carabiner is applied by the climber's weight, wedging forces are applied by the carabiner against the rope resulting in a gripping action to prevent further downward travel along the rope and thereby support the climber's weight at the present location. Friction points extending out from the running surface to engage the rope further enhance the gripping action of the ascender particularly with iced or wet ropes. Thus manually positioning and alternately advancing the ascenders upward along the suspedned rope, the climber progressively climbs to the desired height.

Having no moving parts, the compact and light weight ascender provides an effective yet simple apparatus for rope ascension, meeting the needs of alpinists requiring an alternative to complex mechanical equipment needing maintenance or which are subject to fatique or failure. The ascender may be adapted for use with two or more carabiners, such as in a double rope embodiment.

DESCRIPTION OF THE DRAWINGS

FIG. 1 illustrates mountaineers on a glacier climber using a pair of aascenders with carabiners and slings attached to ascend the safety rope vis a vis the prusiking technique in a crevasse self rescue situation.

FIG. 2 is a perspective view of a climber using the ascenders for rope ascension. The lower ascender is locked in position on the rope by the weight of the climber's left foot. The upper ascender is then being manually positioned at the selected higher elevation on the rope with the climber's right foot being positioned in the sling to apply downward load on the carabiner of the upper ascender which will then fully support the climber's weight.

FIG. 3 is an isometric view of the ascender with a carabiner applying wedging forces against the rope in a gripping action as downward load is applied to the sling shown being attached to the bottom of the carabiner.

DESCRIPTION OF THE PREFERRED EMBODIMENT

Introduction

Figure 4:
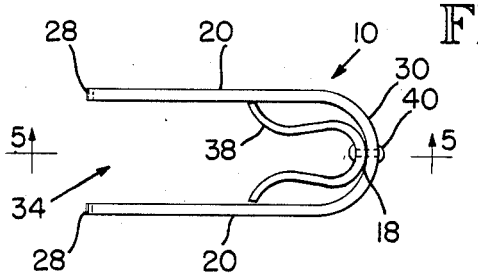
FIG. 4 is an overhead view showing the U-shaped configuration of the ascender and the rope quide positioned near the top of the running surface.

In typical mountaineering practice two or more mountaineers tie themselves together with a climbing or safety rope whenever they cross glaciated mountain areas. Crevasses pose a constant surprise danger. Normal climbing practice allows one or two climbers to catch the fall of a third climber, should he or she fall into a crevasse. All the existing conditions that prevail at the time of rescue dictate the means of rescue. There is fear, shock from the fall, injury, freezing conditions, a heavy pack, ice on rope, and/or the strangulating effect of the safety rope around the climber's chest. These existing conditions make it impossible for the climber to climb out hand over hand. It is also nearly impossible for the climbing partner to pull the fallen climber from the crevasse. Therefore the fallen climber requires a device and its assemby that will allow his or her self rescue. This device must have the following characteristics. It must be very simple and easy to place in mid rope, with one hand overhead. It must work on frozen rope. It must release easily and slide upwardly on the safety rope, yet provide positive locking on ropes of varying sizes. It must be compact, light weight, and affordable. It must be operable under extreme stress and duress, be functional without using auxilliary tools, springs, chains, wires, cams, and/or levers.

Therefore this ascender 10 is especially adapted as being this device for use by mountaineers, during their glacier travel. If one of a group falls into a crevasse, he or she is able to ascend the safety rope 12, as shown in FIG. 1. Such a safety rope 12, before the glacier travel is commenced, is secured to all the mountaineers in a selected group, such as a group of three mountaineers. When one mountaineer falls, the other mountaineers, who fortunately have not fallen, quickly anchor and hold the safety rope 12, to limit the fall of the mountaineer, and to secure the safety rope 12 for him or her to use in climbing out of the crevasse.

To encourage mountaineers at the outset to keep roped together and for each of them to carry two foot slings 16 and gripping accessories secured to belts, etc., a basic, low cost, no moving part, very reliable embodiment of this ascender 10 is provided to be used with a conventional carabiner 14. Each foot sling 16, is secured to a carabiner 14, and each carabiner 14, and each carabiner 14 is also secured to each ascender 10. When a mountaineer's weight is transferred to a foot sling 16, the carabiner 14 is guided on a bias path by the ascender 10 into holding contact with the safety rope 12, which in turn is initially movably guided and then subsequently held within the ascender 10, as the safety rope 12 is frictionally held between a portion of the carabiner 14 and an interior surface of the ascender 10 as shown in FIGS. 1 through 6.

Figure 7:
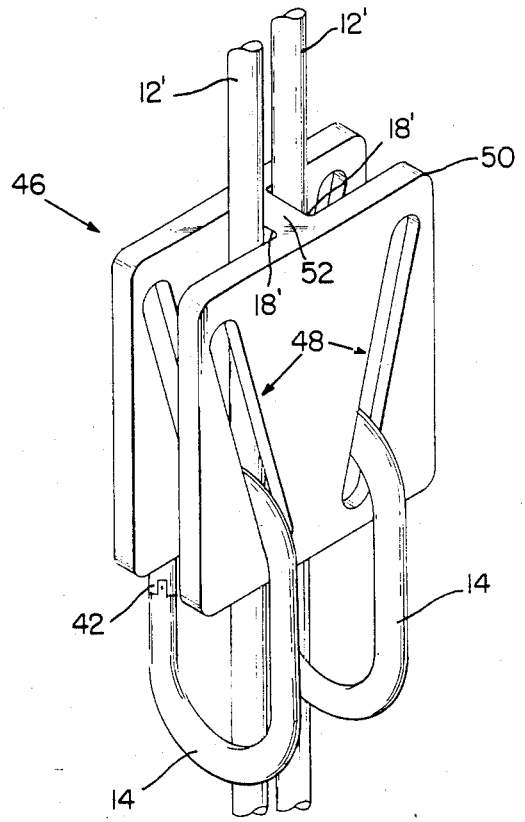
FIG. 7 is a perspective view of another embodiment of the ascender which accomodates two side by side climbing ropes, and wherein two carabiners are used, being positioned within opposing pairs of slots.

In another embodiment of the ascender 46, shown in FIG. 7, the sliding and gripping portions are duplicated to accommodate two side by side climbing ropes 12, adding to the safety margin by having two safety ropes 12 to climb.

Figure 6:
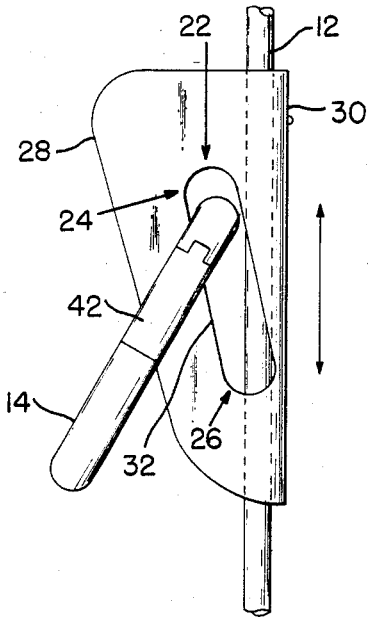
FIG. 6 is a perspective view showing the free action slidable travel of the ascender along the rope when no downward load from the climber's weight is applied to the carabiner. Note the relative position of the carabiner adjacent to the upper end of the slots.
Figure 5:
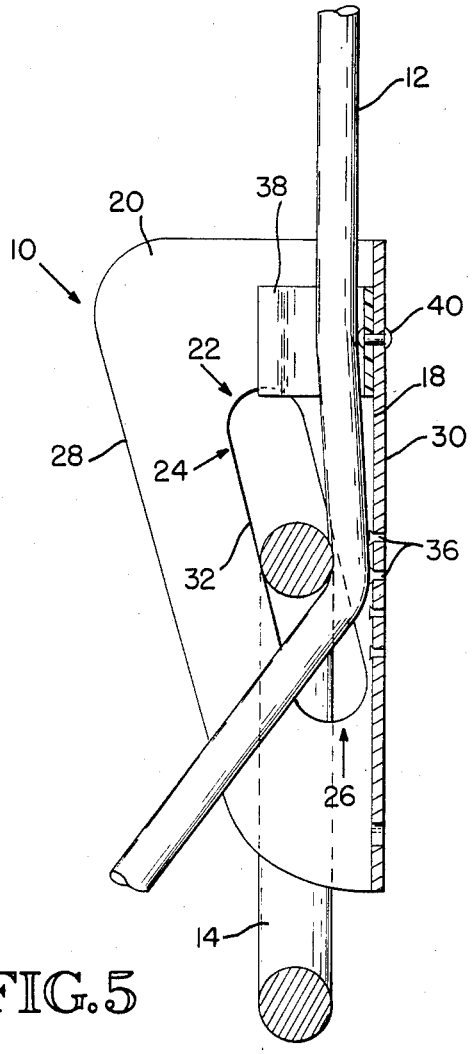
FIG. 5 is a sectional view taken along line 5—5 of FIG. 4 showing the path of travel of the rope through the rope guide and along the running surface. A section of the carbiner is shown imparting wedging forces against the rope, being positioned against the rope and forcing it against the running surface and the friction points as a downward load of the climber's weight is applied to the carabiner.

The Preferred Basic Embodiments of This illustrated in FIGS. 1 through 7 Comprises a One Piece Structure in a Substantially U-shaped Configuration The ascender 10 comprises a one piece structure adapted to be removably attached to a climbing rope 12. As shown in FIG. 4, the preferred embodiment of the ascender is a substantially U-shaped structure serving to partially enclose the rope as a partial sleeve during use. Oppositely spaced apart sides 20 extend outwardly from a back 30 to form the U-shape. The interior surface of the back 30 within the ascender further comprises a curved running surface 18 to partially surround the climbing rope, as shown extending the entire length of the back 30 in FIG. 5. In the preferred embodiment of the ascender 10, each side 20 has a diagonal mirror image elongated slot 22 therethrough, whereby the slots 22 are concentric from side to side of the opposite sides and the slots 22 are symmetrical and are preferably adapted to receive and provide a diagonal and converging path of travel for a mountaineer's carbiner. Each slot 22 has an upper end 24 and lower end 26, as shown in FIGS. 3, 5 and 6.

The ascender 10 may be insertably and removably positioned around the rope 12 through its open end 34, as shown in FIG. 5. The ascender is adapted for sliding travel on the suspended or supported rope 12 along its running surface 18 and is manually positioned by the climber to selected locations or heights on the rope gripping, spring like 12 during the climbing activity. A rope guide 38, preferably made of composite or plastic, and secured by a rivet 40, provides partially rope enclosing frictionally clip on enclosure near the top of the running surface 18 to initially position the ascender 10 on the rope 12 while the fallen suspended climber is securing the foot sling 44 and carabiner 42 to this initially secured ascender 10 to complete the positioning of his or her leg support, i.e. body support subassembly. Thereafter, this rope gripping, spring like guide 38, slidably receives the rope 12 to guide the rope 12. for travel along the running surface 18.

The exterior shape and profile of the preferred embodiment of the ascender is basically triangular as shown in the drawings. Other shapes, including rectangles or other polygons, may be used for alternative embodiments, not shown in the drawings. Regardless of overall shape, the relative positioning and relationship of the slots with respect to the running surface is of particular importance as will be further discussed below.

The Slots of the Ascender are Relatively Positioned to Intersect the Running Surface at an Acute Angle The slots 22 are preferably positioned relative to the running surface of the ascender such that the longitudinal axes of the slots 22 intersect the longitudinal axis of the running surface 18 at an acute angle as shown in FIG. 5. The slots are preferably centrally positioned through the sides, in parallel alignment, with the leading edges 28 of the ascender, and with each other as shown in FIG. 5. The forward surface of each slot further comprises a ramp 32.

The slots 22 extend from their upper end 24 to terminate at their lower end 26 adjacent to the running surface 18 and the back 30 of the ascender.

As shown in FIGS. 3 and 5 that the slots extend far enough at their lower ends 26 to intersect the longitudinal axis of the rope 12 when it is positioned along the running surface 18.

While climbing, the rope is held taught, by the weight of the climbers, in a relatively vertical position. The ascender 10 is therefore positioned on the rope whereby the running surface 18 extends vertically as shown in FIGS. 3 and 5. The relative position of the slots 22 to the running surface 18 creates a steep downward slope for the converging and gripping path of travel of the carabiner 14 within the slots and their respective ramps 32, as shown in FIGS. 3 and 5.

The Ascender is Adapted for Use With a Standard Carabiner Which Serves as the Gripping Means to Lock the Ascender in Place on the Rope and Support the Load Created by the Climber's Weight To maintain the climber's position on the rope, a standard oval or D-shaped carabiner 12 is preferably used in combination with the ascender 10 to provide the gripping means, locking the ascender in place on the rope 12 and supporting downward load created by the weight of the climber at the established position, shown in FIGS. 2, 3, and 5. Normally carried by most climbers for various purposes, carabiners typically have a spring loaded gate 42, which when depressed, allows the carabiner 14 to be clipped through the slots 22 after the ascender is placed on the rope 12 and is then sufficiently frictionally held in its alignment position in the rope guide 38. The attached carabiner 12 itself additionally serves to keep the ascender 10 loosely connected to the climbing rope at all times.

When a downward load of the climber's foot is applied, however, the carabiner 14 is slidingly forced from its free action location at the upper ends 24 to the lower ends 26 of the slots, being supportively braced against the ramps 32 on one side and thereby compressing the rope against the running surface 18 as shown in FIG. 5. The imparted wedging forces against the rope by the carabiner 14 thereby frictionally lock the ascender 10 in position, preventing further downward travel along the rope 12 and support the climber's weight which is in turn supported by the sling 16 attached to the carabiner 14. When the load imparted by the climber's weight is removed from the carabiner 14, free action travel along the rope in either direction is permitted thus climber to manually position the ascender with one hand at a subsequent height.

The relative length and orientation of the slots 22 with respect to the running surface 18 facilitates gripping action of the carabiner 14 on ropes of varying diameter.

The Ascender May be Adapted for Use in Ascending Fixed Ropes or Serving as an Aid in Crevasse Self-Rescue for Mountaineers This preferred embodiment of the ascender 10 is principally constructed to be used by a climber to ascend from a crevasse in a self rescue situation up a rope belayed by his or her fellow climbers or mountaineers, as they fortunately have secured themselves above the crevasse and hold the rope commonly secured to all of them. During glacier travel the climbers are roped together at their midsection at spaced intervals along the length of the rope 12. Each climber will carry a pair of ascenders 10 and carabiners, each carabiner 14 having a sling 16 attached thereto with a large foot loop 44 fashioned at the bottom of the slimg 16, as shown in FIG. 2. If a climber slips into a crevasse, he or she will be supported by the climbing rope 12. Other party members above will be anchoring the rope 12 above the crevasse as shown in FIG. 1. Rather than the other members pulling the climber up, which is often quite difficult, the climber may endeavor to ascend the rope on his own. The climber places an ascender 10 about the rope 12 utilizing the gripping spring like rope guide 38 and then clips a carabiner 14, supporting a sling 16, to the carabiner by first passing portions of the carabiner 14 through the mirror image slots 22, and thereafter, the climber repeats such fastening steps to secure the other assembly of the ascender 10, carabiner 14 and sling 26 to the rope 12, just above the first assembly. Each of the climber's feet are therafter inserted into a foot loop 44 or loop 44.

The climber's weight is supported alternately by each loop 44 when its respective carabiner 14 is wedged against the rope 12. To release the ascender 10 from its locked position on the rope, the climber after transferring his weight to the other foot sling 16, grasps the carabiner pushing it upwardly toward the upper end 24 of the slots, and then he or she moves the entire assembly farther up the rope.

Thus the climber alternately slides each ascender utilizing the gripping spring like rope guide 38 with its assembled carabiner 14 and sling 16, with most of his or her weight removed to the desired height on the rope, and therafter transfer his or her weight on respective just raised foot loop 44 in this climbing sequence of a step at a time, alternatively using the respective assemblies of the ascender 10, carabiner 14 and sling 16 to progressively climb another step from the crevasse utilizing the gripping spring like rope guide 38 with its assembled carabiner 14 and sling 16.

The ascender may also be used in technical climbing of ice and rock where a fixed rope is suspended from an anchor or is belayed from above.

Upon completion ascension of a rope, the carbiners may be quickly unclipped from the ascender allowing the ascenders to be removed from the rope and stored in the climber's pack or pocket.

The ascender is preferably made of aluminum or composite material such as ABS plastic or graphite.

A plurality of friction points 36 depend from the running surface 18, adjacent to the lower ends 26 of the slots. They are adapted to engage the rope and enhance gripping forces particularly on wet or iced ropes. Alternative frictional means may be served by a corrugated or raised running surface in the region of the lower ends 26 of the slots 22.

Another Embodiment

As shown in FIG. 7, another embodiment of the ascender 46 is adapted for use with two ropes 12' preferably having opposing pairs of slots 48 formed within a substantially I shaped body 50. Carabiners 14' are clipped respectively through each pair of the opposing pairs of slots 48 to provide the rope gripping means to lock each rope 12' against a respective running surface 18' of the two formed on the respective opposite sides of the cross member 52.

I claim:

1. An ascender to be used in each pair of respective assemblies of an ascender, a carabiner, and a foot sling, to be utilized by a climber in ascending a supporting rope, comprising the integral portions thereof, of:

(a) a substantially U-shaped vertically positioned curved back;

(b) a rope receiving inner surface of the U-shaped back, which becomes a rope running surface, under no load of a climber's weight, and becomes a rope gripping surface under the load of a climber's weight;

(c) vertical sides extending longitudinally out from the U-shaped curved back beyond any diameter of a rope located along the rope receiving inner surface;

(d) elongated diagonal slotted openings, being a mirror image of one another, and converging at their respective bottoms near the rope receiving inner surface, and being sized to receive a portion of a removable carabiner, whereby when a foot sling is attached to a carabiner and a climber places his or her foot in the sling and then places his body weight on the sling, the sling conveys the downward pull to the carabiner, which in turn is pulled downwardly, while guided in the elongated diagonal slotted openings, to then make a locking contact with a supporting rope, as the rope is non slidably held between the carabiner and the rope receiving inner surface, until the other then non loaded foot sling, carabiner, and ascender, as an assembly, is slidably raised, after and while the carabiner is elevated in the elongated diagonal slotted openings to be released free of the rope, to reach a new location above along the rope, where the assembly will be non slidably held in place, thereafter these respective assemblies of the foot sling, carabiner, and ascender are alternatively loaded, unloaded, and moved upwardly, along the rope, as the climber so supported ascends the rope.

2. An ascender, as claimed in claim 1, arranged with another like ascender in an integral back to back embodiment to accommodate an ascent by a climber up two side by side supporting ropes.

* * * * *